United States Patent [19]

Tanaka et al.

[11] 4,399,775

[45] Aug. 23, 1983

[54] SYSTEM FOR CONTROLLING COOLING WATER TEMPERATURE FOR A WATER-COOLED ENGINE

[75] Inventors: Takayuki Tanaka, Komae; Noriaki Kadoi, Musashino; Akio Yoshimoto, Mitaka, all of Japan

[73] Assignee: Fuji Jukogyo Kabushiki Kaisha, Tokyo, Japan

[21] Appl. No.: 371,759

[22] Filed: Apr. 26, 1982

[30] Foreign Application Priority Data

Apr. 30, 1981 [JP] Japan ..... 56-65673

[51] Int. Cl.[3] ..... F01P 7/14

[52] U.S. Cl. ..... 123/41.08; 123/41.44; 236/34.5

[58] Field of Search ..... 237/12.3 B; 236/34, 236/34.5; 165/40; 123/41.02, 41.08, 41.44

[56] References Cited

U.S. PATENT DOCUMENTS 3,851,629 12/1974 Mayr et al. ..... 236/34.5 X

*Primary Examiner*—William E. Tapolcai

*Attorney, Agent, or Firm*—Martin A. Farber

[57] ABSTRACT

A system for controlling cooling water temperature for a water-cooled engine has a radiator, a cooling water passage communicating a water jacket in the engine with the radiator, and a thermostat provided in the cooling water passage. The system is provided with a bypass for bypassing the thermostat, a bypass valve provided in the bypass for closing the bypass, and a solenoid operated valve for actuating the bypass valve. Switch circuits are connected parallel to a solenoid of the solenoid operated valve means. The switch circuits comprise a thermo-switch responsive to low cooling water temperature to effect the operation of the solenoid operated valve for closing the bypass valve of the bypass, a vacuum switch responsive to a vacuum in the intake passage at heavy load operation of the engine to effect the operation of said solenoid operated valve for opening the bypass valve, whereby the cooling water temperature is controlled according to the engine operation.

2 Claims, 2 Drawing Figures

SYSTEM FOR CONTROLLING COOLING WATER TEMPERATURE FOR A WATER-COOLED ENGINE

BACKGROUND OF THE INVENTION

The present invention relates to a system for controlling cooling water temperature for an engine mounted on an automotive vehicle and more particularly to a system which controls the temperature of the cooling water to a proper temperature according to load on the engine and conditions of the engine.

Japanese patent publication No. 54-9665 discloses a cooling water control system which is provided with two thermostats for low temperature control and high temperature control and with a valve for controlling the cooling water which is opened in dependency on the load on the engine. The system has disadvantages that the two thermostats occupy a large space. Since the valve is opened in association with the throttle valve of the engine or opened by the vacuum in the intake passage of the engine, the valve is frequently opened during the driving of vehicle. Accordingly, the cooling water often circulates, resulting in excessive cooling of the engine. Therefore, cooling losses increase and thermal efficiency decreases.

SUMMARY OF THE INVENTION

The object of the present invention is to provide a cooling water controlling system which controls the temperature of the cooling water without sensitively responding to frequent variation of the vacuum in the intake passage and cools the water properly at full load operation. In the system of the present invention, the cooling water flow to a radiator is regulated by a valve which is operated at full load operation of the engine.

According to the present invention, there is provided a system for controlling cooling water temperature for a water-cooled engine having an intake passage, a radiator, a cooling water passage communicating a water jacket in the engine with the radiator, and a thermostat provided in the cooling water passage, the thermostat being so arranged as to open the passage when the cooling water temperature exceeds a predetermined value, the system comprising a bypass for bypassing the thermostat; a bypass valve provided in the bypass for closing the bypass; solenoid operated valve means for actuating the bypass valve; and a thermo-switch and a vacuum switch connected parallel to a solenoid of the solenoid operated valve means; the thermo-switch being responsive to a low cooling water temperature to effect the operation of the solenoid operated valve for closing the bypass valve of the bypass, the vacuum switch having a vacuum chamber which is communicated with the intake passage via a damper valve, the vacuum switch being responsive to a vacuum at heavy load operation to effect the operation of the solenoid operated valve for opening the bypass valve.

The other objects and features are explained more in detail with reference to the accompanying drawings.

DETAILED DESCRIPTION OF THE PREFERRED EMBODIMENTS

Figure 1:
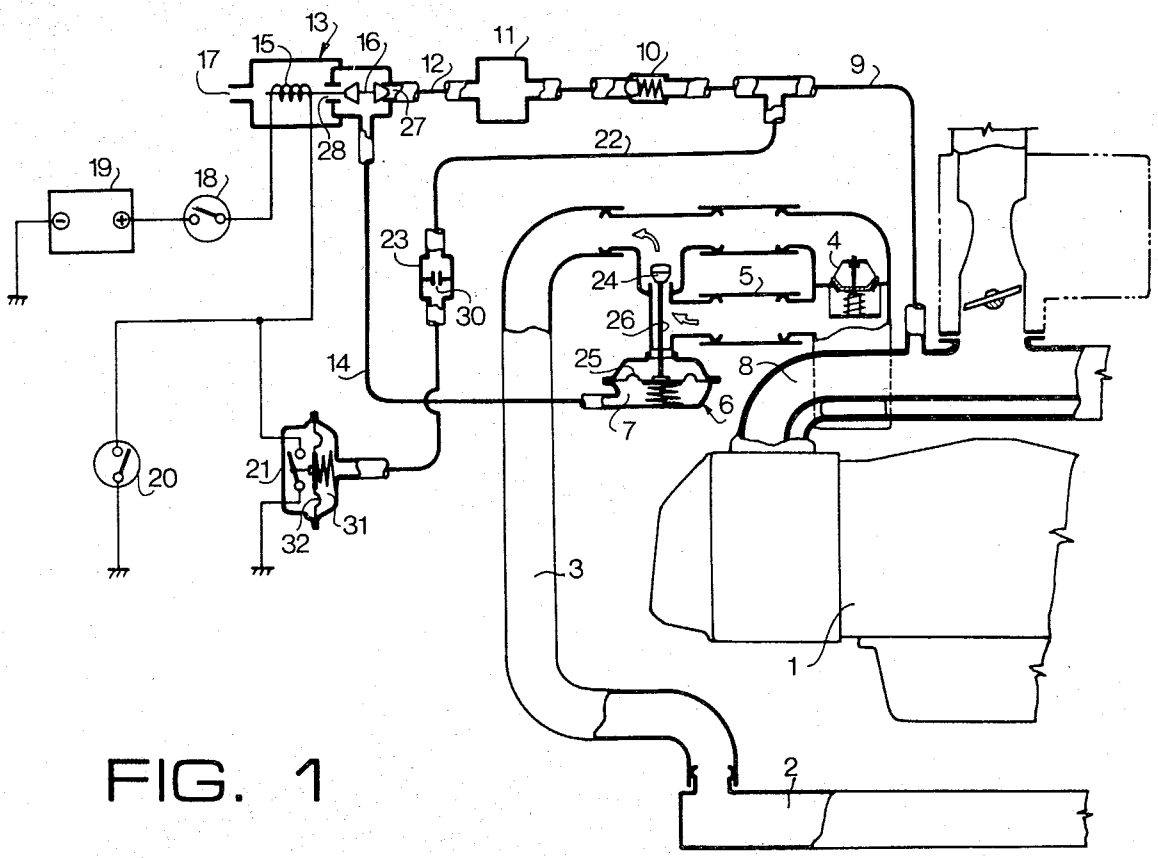
FIG. 1 shows schematically a system for controlling cooling water according to the present invention.

Referring to FIG. 1, an engine 1 has a cooling water system comprising a radiator 2, a cooling water passage 3 communicating a water jacket in the engine 1 with the radiator 2. In the cooling water passage 3, a thermostat 4 is provided. The thermostat 4 is a wax pellet type valve and is adapted to open when the temperature of the cooling water exceeds a predetermined value for allowing the cooling water to flow to the radiator 2. In accordance with the present invention, a bypass 5 is provided to bypass the thermostat 4. A vacuum operated valve 6 is provided in the bypass 5. The valve 6 comprises a valve body 24, a vacuum chamber 7 defined by a diaphragm 25, and a rod 26 connecting the valve body 24 with the diaphragm 25. The vacuum operated valve 6 is adapted to close the bypass, when the diaphragm 25 is deflected by vacuum applied in the vacuum chamber 7.

The vacuum chamber 7 is communicated with a vacuum accumulator 11 through a conduit pipe 14, a solenoid operated valve 13 and a conduit pipe 12. The vacuum accumulator 11 is communicated with an intake manifold 8 through a check valve 10 and a conduit pipe 9. The valve 13 comprises a solenoid 15, a vacuum port 27, an atmosphere port 28, a valve body 16 connected to a plunger of the solenoid for closing one of the ports 27 and 28, and an atmosphere port 17. One end of the solenoid 15 is connected to a battery 19 via an engine ignition switch 18, and the other end is connected to the ground via a switch circuit which comprises a thermo-switch 20, and a vacuum switch 21.

The thermo-switch 20 is adapted to open when the cooling water temperature is higher than a predetermined temperature which is set to a lower temperature than the thermostat operating temperature. The vacuum switch 21 is adapted to be turned on by a high vacuum in the intake manifold 8 at a partial load. To this end, the switch 21 has a vacuum chamber 31 and a diaphragm 32 deflected by the vacuum in the vacuum chamber for operating the switch. The vacuum chamber 31 is communicated to the intake manifold 8 through a conduit pipe 22, a restriction 23 and the conduit pipe 9. The restriction 23 comprises an orifice 30 and serves to absorb small and frequent fluctuation of the vacuum in the intake manifold which is caused by the variation of load on the engine. Therefore, the vacuum switch 21 is turned off by a low vacuum in the intake manifold, when heavy load operation continues for a while. The thermostat 4 is so designed as to open at a considerable high temperature, for the purpose of an increase of thermal efficiency and an improvement of fuel consumption.

Figure 2:
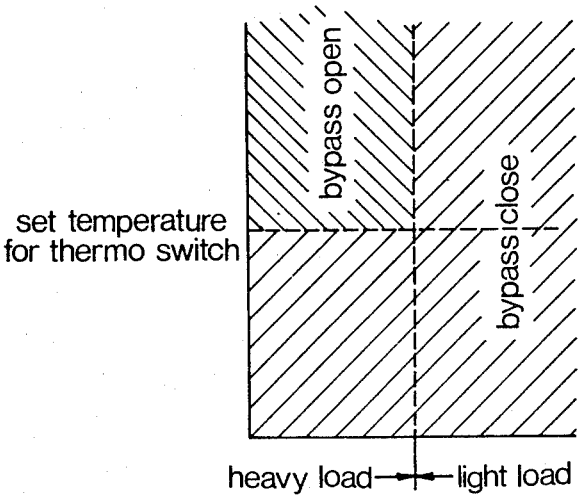
FIG. 2 is a graph showing operating range of a bypass.

In light load operation, the vacuum switch 21 is closed by the vacuum applied from the intake passage 8 through the restriction damper 23. The solenoid 15 is excited to open the vacuum port 27. On the other hand, when the water temperature is lower than the set value of the switch 20, the switch 20 is closed thereby to excite the solenoid 15, even if at full load operation. Accordingly, the vacuum in the accumulator 11 is fed to the vacuum chamber 7 of the valve 6 through the pipes 12 and 14, so that the valve body 26 closes the port of the bypass 5. Therefore, the cooling water flow to the radiator is controlled by the thermostat 4, and hence the temperature of the cooling water is adjusted below the set high temperature. Thus, warming up efficiency of the engine is increased. When the engine operates at a heavy load with a wide throttle opening for a time longer than a time depend on the operation of restriction 23, a low vacuum in the manifold 8 turns off the vacuum switch 21. Therefore, if the cooling water temperature is higher than the set temperature of the switch 20, the solenoid 15 is de-energized. Thus, the atmosphere port 28 is opened, so that the atmosphere is applied to the vacuum chamber 7 of the valve 6 to open the bypass. Accordingly, the cooling water passes through the bypass to the radiator 2 without temperature control with the thermostat. Thus, the cooling effect for the cooling water and thermal efficiency of the engine are increased. FIG. 2 shows operating ranges of the bypass.

From the foregoing it will be understood that the present invention provides a system by which the temperature of the cooling water is controlled for improving the fuel consumption and increasing the output of the engine.

Further, the bypass is opened for cooling the water, only when heavy load operation continues for a while at a high water temperature. Therefore, fuel consumption in steady driving may be improved.

While the presently preferred embodiment of the present invention has been shown and described, it is to be understood that this disclosure is for the purpose of illustration and that various changes and modifications may be made without departing from the spirit and scope of the invention as set forth in the appended claim.

What is claimed is:

1. A system for controlling cooling water temperature for a water-cooled engine having an intake passage, a radiator, a cooling water passage communicating a water jacket in said engine with said radiator, and a thermostat provided in said cooling water passage, said thermostat being so arranged as to open said passage when the cooling water temperature exceeds a predetermined value, said system comprising a bypass for bypassing said thermostat;

a bypass valve provided in said bypass for closing the bypass;

solenoid operated valve means for actuating said bypass valve; and a thermo switch and a vacuum switch connected parallel to a solenoid of said solenoid operated valve means;

said thermo switch being responsive to a low cooling water temperature to effect the operation of said solenoid operated valve for closing said bypass valve of said bypass, said vacuum switch having a vacuum chamber which is communicated with said intake passage via a restriction, said vacuum switch being responsive to a vacuum at heavy load operation to effect the operation of said solenoid operated valve for opening said bypass valve.

2. The system for controlling cooling water temperature for a water-cooled engine according to claim 1 wherein said bypass valve provided in said bypass is a vacuum operated valve.

* * * * *